US010769993B2

(12) United States Patent
Soda

(10) Patent No.: US 10,769,993 B2
(45) Date of Patent: Sep. 8, 2020

(54) ORGANIC ELECTROLUMINESCENCE DISPLAY APPARATUS

(71) Applicant: CANON KABUSHIKI KAISHA, Tokyo (JP)

(72) Inventor: Takehiko Soda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/129,430

(22) Filed: Sep. 12, 2018

(65) Prior Publication Data

US 2019/0096324 A1 Mar. 28, 2019

(30) Foreign Application Priority Data

Sep. 25, 2017 (JP) ..... 2017-183510

(51) Int. Cl.
*G09G 3/3233* (2016.01)
*G09G 3/20* (2006.01)

(52) U.S. Cl.
CPC ..... *G09G 3/3233* (2013.01); *G09G 3/2074* (2013.01); *G09G 2300/0452* (2013.01); *G09G 2300/0456* (2013.01); *G09G 2300/0852* (2013.01); *G09G 2310/0262* (2013.01); *G09G 2320/0242* (2013.01); *G09G 2320/0626* (2013.01)

(58) Field of Classification Search
CPC ..... G09G 3/3233; G09G 3/2074
See application file for complete search history.

(56) References Cited

U.S. PATENT DOCUMENTS 9,307,584 B2 * 4/2016 Ko ..... H01L 27/3216
2004/0207577 A1 * 10/2004 Ito ..... G09G 3/3225 345/76
2010/0007587 A1 * 1/2010 Miller ..... G09G 3/3216 345/77
2012/0001838 A1 * 1/2012 Tsubata ..... G02F 1/134336 345/87
2014/0022499 A1 * 1/2014 Tamaki ..... G02F 1/13439 349/106
2015/0109565 A1 * 4/2015 Takeda ..... G02F 1/134309 349/106
2018/0190197 A1 * 7/2018 Chang ..... G09G 3/3233

FOREIGN PATENT DOCUMENTS

JP 2015-102723 A 6/2015

* cited by examiner

*Primary Examiner* — Kevin M Nguyen
(74) *Attorney, Agent, or Firm* — Canon U.S.A., Inc. IP Division

(57) ABSTRACT

A display apparatus includes a pixel including a first sub-pixel and a second sub-pixel disposed adjacently to each other, and the second sub-pixel is different in emission color from the first sub-pixel. Each of the first sub-pixel and the second sub-pixel includes a first electrode, a second electrode, and a functional layer disposed between the first electrode and the second electrode. The first electrode of the first sub-pixel includes a first pixel electrode and a second pixel electrode. The first electrode of the second sub-pixel includes a first pixel electrode and a second pixel electrode. The second pixel electrode of the first sub-pixel is disposed in each of regions between the first sub-pixel and the second sub-pixel.

16 Claims, 7 Drawing Sheets

ORGANIC ELECTROLUMINESCENCE DISPLAY APPARATUS

BACKGROUND

Field of the Disclosure

The present disclosure generally relates to display technology and, more particularly, to a display apparatus and to an imaging apparatus including the display apparatus.

Description of the Related Art

In recent years, various types of display apparatuses have attempted to realize high color reproducibility. These display apparatuses are apparatuses including a plurality of pixels. Further, each of the pixels includes a plurality of sub-pixels different in emission color from one another.

A display apparatus using an organic electroluminescence (hereinafter, referred to as organic EL) device includes characteristics such as a reduced thickness and a high contrast ratio, and attracts attention as a next-generation display device.

An existing organic EL display apparatus is of a type in which organic EL materials of red (R), green (G), and blue (B) are selectively applied with use of a mask in vapor deposition, or of a type in which light of each of colors RGB is extracted by a combination of a color filter and an organic EL device that emits white light without performing selective application of the organic EL materials of RGB.

Further, as a method of driving the organic EL display apparatus, an active matrix method that controls a signal for an image to be supplied to a display device with use of a transistor inside a pixel, is known.

In such organic EL display apparatuses, it is known that an electrode is divided, and divided individuals are independently controlled to more accurately control light emission characteristics of the organic EL display apparatuses in order to optimize the light emission characteristics.

Japanese Patent Application Laid-Open No. 2015-102723 discusses that an electrode causing sub-pixels to emit light is divided into a pixel electrode with a large light emission area and a pixel electrode with a small light emission area, within a pixel surface. A current is supplied to the pixel electrode with the large light emission area in a high-luminance state where a light emission amount is large, and a current is supplied to the pixel electrode with the small light emission area in a low-luminance state where the light emission amount is small. This makes it possible to accurately control the current to be supplied also in the low-luminance state, and to more accurately express luminance according to gradation.

In the display apparatus that includes a plurality of types of pixels different in emission color, in a case where one of the pixels emits light, it is preferable to consider influence on an adjacent pixel. In particular, in the organic EL display apparatus, a common layer formed in common to the pixels is present in some cases, and a leakage current flowing through the common layer is preferably suppressed. The adjacent pixel also slightly emits light due to the leakage current, which deteriorates color reproducibility.

The organic EL display apparatus discussed in Japanese Patent Application Laid-Open No. 2015-102723 includes a large light emitting device and a small light emitting device in one sub-pixel in order to express accurate gradation; however, measures against the leakage current between the sub-pixels are not sufficient.

In a case where a distance between a pixel electrode of the small light emitting device and a pixel electrode of the large light emitting device is small, a leakage current to the pixel electrode of the large light emitting device of the adjacent pixel occurs when it intends to supply the current to the pixel electrode of the small light emitting device. Further, in a case where the emission color of the large light emitting device is different from the emission color of the small light emitting device, color reproducibility is deteriorated.

SUMMARY

The present disclosure generally relates to display technology that achieves excellent color reproducibility by suppressing influence of a pixel on an adjacent pixel different in emission color from the pixel.

According to one or more aspects of the present disclosure, a display apparatus includes a pixel including a first sub-pixel and a second sub-pixel disposed adjacently to each other, and the second sub-pixel is different in emission color from the first sub-pixel. Each of the first sub-pixel and the second sub-pixel includes a first electrode, a second electrode, and a functional layer disposed between the first electrode and the second electrode. The first electrode of the first sub-pixel includes a first pixel electrode and a second pixel electrode. The first electrode of the second sub-pixel includes a first pixel electrode and a second pixel electrode. The second pixel electrode of the first sub-pixel is disposed in each of regions between the first sub-pixel and the second sub-pixel.

Further features of the present disclosure will become apparent from the following description of exemplary embodiments with reference to the attached drawings.

DESCRIPTION OF THE EMBODIMENTS

Various exemplary embodiments, features, and aspects of the present disclosure will be described in detail below with reference to the drawings.

A display apparatus according to an exemplary embodiment may include a plurality of types of pixels different in emission color, and in the display apparatus, influence of a sub-pixel on an adjacent sub-pixel different in emission color from the sub-pixel may be suppressed to suppress unintentional light emission of the adjacent sub-pixel when the sub-pixel emits light.

In the present disclosure, light emission of the pixel may indicate a state where light is output from the pixel, and the light may be spontaneously-emitted light or transmitted light. In other words, the display apparatus may be an organic electroluminescence (EL) display apparatus or a liquid crystal display apparatus.

One or more electrodes included in the sub-pixel may include a first pixel electrode and a second pixel electrode, and the second pixel electrode is disposed between the first pixel electrode of the sub-pixel and an electrode of an adjacent sub-pixel. This enables suppression of influence on the adjacent sub-pixel. The influence indicates a leakage current to the adjacent pixel in the organic EL display apparatus.

The display apparatus according to an exemplary embodiment of the present disclosure may include a pixel, and the pixel may include a first electrode, a second electrode, and a functional layer disposed between the first electrode and the second electrode. The functional layer may contain an organic compound or an inorganic compound. Further, the functional layer may emit light spontaneously, or may control transmitted light. In a case where the functional layer emits light spontaneously, the functional layer may be a light emitting layer of an organic EL device. In a case where the functional layer controls transmitted light, the functional layer may be a liquid crystal.

In the display apparatus according to the exemplary embodiment of the present disclosure, the second pixel electrode may be disposed to surround the first pixel electrode. Further, a part of the first pixel electrode may not be adjacent to the second pixel electrode.

In the display apparatus according to the exemplary embodiment of the present disclosure, all of the sub-pixels may each include the first pixel electrode and the second pixel electrode. Further, only some of the sub-pixels may each include the first pixel electrode and the second pixel electrode.

The display apparatus according to the present disclosure will be described below by taking an organic EL display apparatus as an example.

[Electrode Configuration of Organic EL Display Apparatus]

Figure 1:
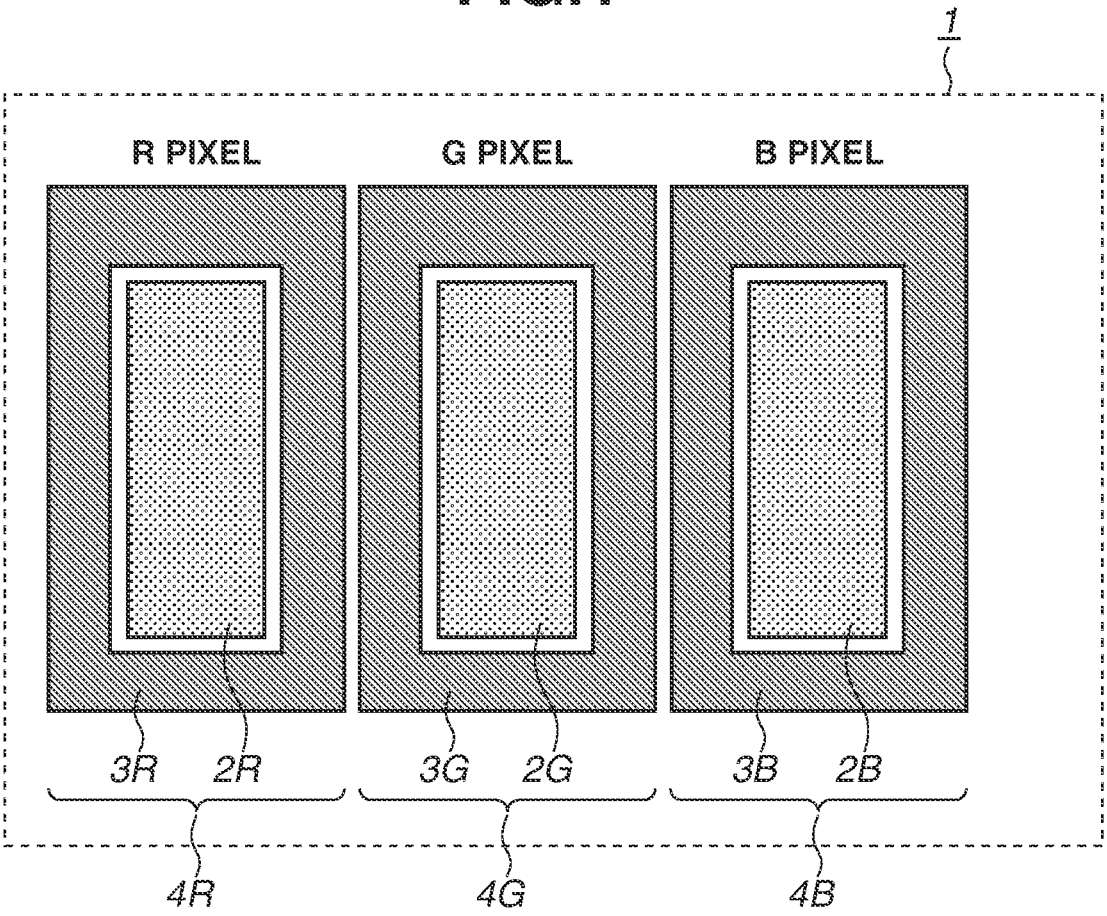
FIG. 1 is a plan view illustrating an example of a pixel according to an exemplary embodiment of the present disclosure.

A first exemplary embodiment is described. FIG. 1 is a plan view illustrating a first electrode of a pixel. A pixel 1 includes three sub-pixels of a red (R) pixel, a green (G) pixel, and a blue (B) pixel. A first electrode 4 of each of the sub-pixels includes a first pixel electrode 2 and a second pixel electrode 3. The second pixel electrode 3 is disposed between the first pixel electrodes 2 of the respective sub-pixels adjacent to each other. For example, a second pixel electrode 3G and a second pixel electrode 3B are disposed between a first pixel electrode 2G of the G pixel and a first pixel electrode 2B of the B pixel. An unillustrated organic EL layer is provided, as a common layer for a plurality of pixels, on each of the first electrodes. The common layer is a layer formed so as not to be separated in a plane.

The display apparatus may include a control unit that controls a ratio of currents supplied to the first pixel electrode and the second pixel electrode.

The control unit may include one or more processors and one or more memories, and may perform control such that a ratio of the current flowing through the first pixel electrode 2 to the current flowing through the second pixel electrode 3 becomes larger as luminance to be displayed is smaller, in order to reduce a leakage current between the sub-pixels. In contrast, the control unit may perform control such that the ratio of the current flowing through the first pixel electrode 2 to the current flowing through the second pixel electrode 3 becomes smaller as the luminance to be displayed is larger. Further, in a case where light emission with high luminance is necessary for high dynamic range (HDR) display, the current may be supplied to the first and second pixel electrodes without considering the above-described ratio. The display apparatus may include an HDR mode in which the ratio of the currents supplied to the first pixel electrode and the second pixel electrode is not considered. In particular, in a case of using an organic EL device, the HDR display is advantageously performed because of a high contrast ratio.

Figure 2:
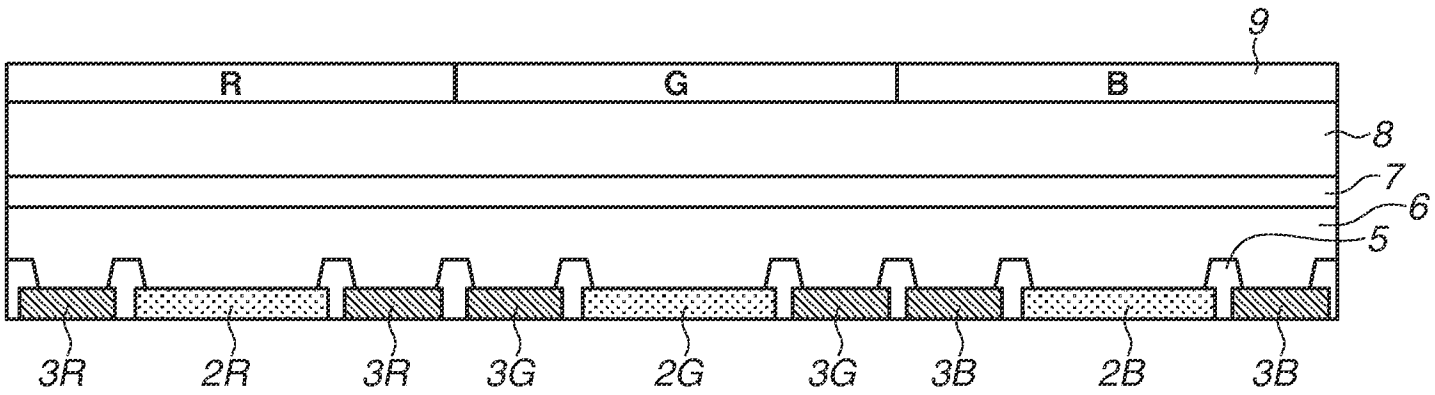
FIG. 2 is a cross-sectional view illustrating an example of the pixel according to an exemplary embodiment of the present disclosure.

FIG. 2 is a cross-sectional view of the pixel including the three sub-pixels of red (R), green (G), and blue (B). The components that are the same as the components in FIG. 1 are denoted by the same reference numerals. The pixel electrode of each of the sub-pixels may be divided into the first pixel electrode 2 and the second pixel electrode 3. A device isolation layer 5 that may be an insulation layer may be disposed between the pixel electrodes. The device isolation layer may also refer to a bank.

An organic EL layer 6 that emits white light is provided on the pixel electrodes and the device isolation layer 5, as a common layer without being planarly separated. As the organic EL layer 6, for example, a charge injection layer and a light emitting layer are deposited in order, to form an organic layer corresponding to a function. A second electrode 7 is provided on the organic EL layer 6 in common to all of the sub-pixels. The second electrode may be provided in common to all of the pixels. Being provided in common indicates that the component is disposed without being planarly separated.

An insulation layer 8 is stacked on the second electrode 7, and color filters 9 are provided on the insulation layer 8. The respective color filters corresponding to the three sub-pixels of red (R), green (G), and blue (B) and the organic EL device that emits white light are combined, which allows for extraction of light of each of colors R, G, and B from the white light.

Next, reasons why color reproducibility may be improved in a low-luminance state is described with use of, as an example, a case where display with low luminance is performed only by the G pixel. In the case where display with low luminance is performed by the G pixel, the ratio of the current flowing through the pixel electrode 2G to the current flowing through the pixel electrode 3G may become large. A distance between the pixel electrode 2G and any of the pixel electrodes (2R, 3R, 2B, and 3B) of the adjacent sub-pixel is sufficiently larger than a distance between the pixel electrode 3G and any of the pixel electrodes of the adjacent sub-pixel. Therefore, the leakage current leaked to the adjacent sub-pixel hardly occurs in the pixel electrode 2G. This makes it possible to suppress leakage current leaked to the adjacent sub-pixel. When the leakage current flowing through the adjacent sub-pixel is reduced, the amount of light emission of the adjacent sub-pixel caused by the leakage current is suppressed, which makes it possible to improve color reproducibility.

Reduction of color reproducibility may be remarkable particularly in the low-luminance state. This is because, in a case where a minute current is supplied to the pixel electrode so that light is emitted, a rate of the current leaked to the adjacent pixel may be increased.

An effect of improving color reproducibility is high in a case where the display with low luminance is performed by the display apparatus. Therefore, the above-described control may be used in a case where the display with luminance equal to or lower than predetermined luminance is performed.

More specifically, light emission by the R pixel or the B pixel may be suppressed when the G pixel emits light, which allows for light emission of intended green color. The effect may be similarly achieved in the R pixel and the B pixel. As a result, an area of a triangle drawn by connecting, with segments, displayed RGB emission colors on a chromaticity coordinate may be increased.

In contrast, in a case where display with high luminance is performed by the G pixel, the ratio of the current flowing through the pixel electrode 2G to the current flowing through the pixel electrode 3G may become small. A distance between the pixel electrode 3G and the pixel electrode of the adjacent sub-pixel, in particular, a distance between the pixel electrode 3G and each of the first electrode 4R and the first electrode 4B is small as compared with the pixel electrode 2G. Therefore, a leakage current easily flows through the adjacent sub-pixels. The ratio of the leakage current to the current flowing through the pixel electrode 3G, however, may be small as compared with a case of the display with low luminance because a current larger than the current in the case of the display with low luminance may flow through the pixel electrode 3G. As a result, the influence of the leakage current may be negligible and influence on color reproducibility may also be small, as compared with a case of the display with low luminance.

Figure 3:
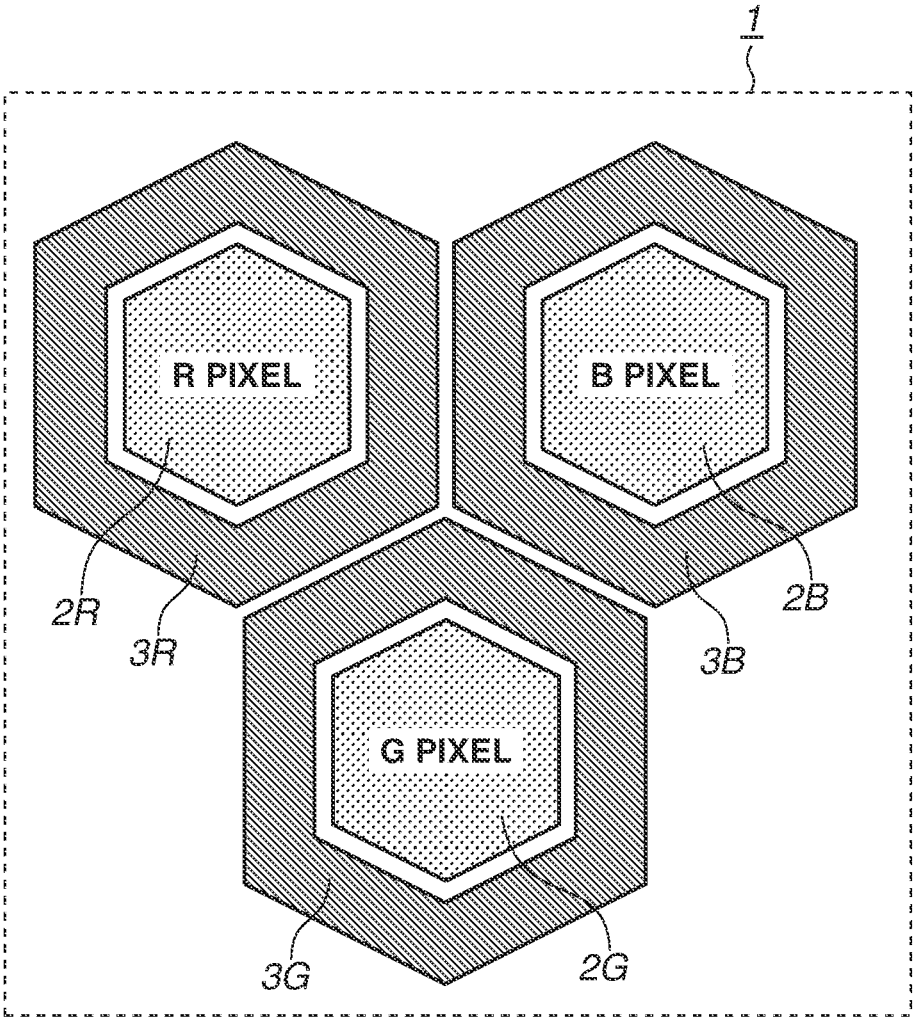
FIG. 3 is a plan view illustrating an example of the pixel according to an exemplary embodiment of the present disclosure.

FIG. 1 illustrates the example in which the first electrodes are arranged in a stripe shape; however, the arrangement is not limited thereto. For example, the first electrodes may be arranged in a delta arrangement as in a plan view illustrated in FIG. 3. In the delta arrangement, the first electrodes are arranged in a triangle (delta) shape with the sub-pixels as vertices.

[Circuit Configuration of Organic EL Display Apparatus]

Figure 4:
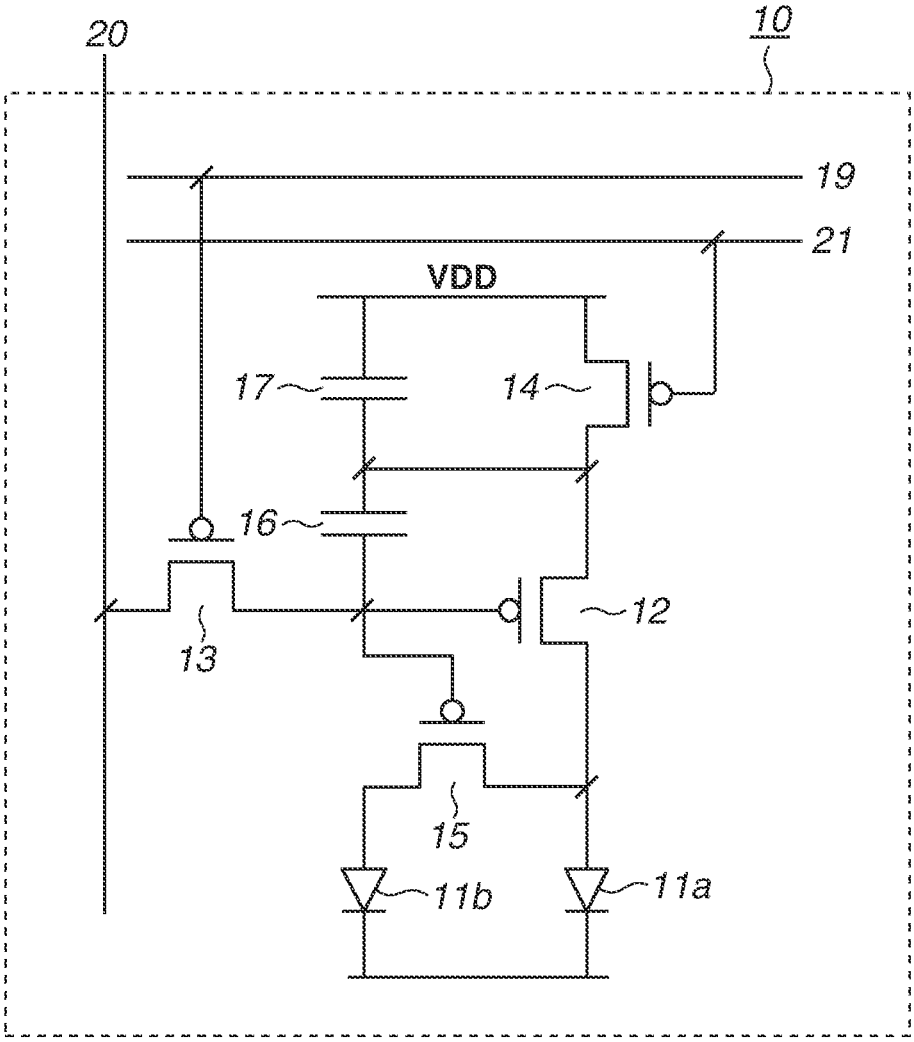
FIG. 4 is an equivalent circuit diagram illustrating an example of a pixel circuit according to an exemplary embodiment of the present disclosure.

FIG. 4 illustrates an example of a pixel circuit used in the organic EL display apparatus according to the exemplary embodiment of the present disclosure. In FIG. 4, a sub-pixel 10 includes an organic EL device 11 and a drive circuit that drives the organic EL device 11. The organic EL device 11 is illustrated while being divided into organic EL devices 11*a* and 11*b*. The organic EL device 11 is connected to a second electrode (not illustrated) provided in common to all sub-pixels 10. The second electrode may be a cathode electrode. An anode electrode that is a first electrode of the organic EL device 11 is divided into two electrodes for each sub-pixel. Therefore, the organic EL device 11 is correspondingly denoted by the organic EL device 11*a* and the organic EL device 11*b*. The organic EL device 11*a* includes a circuit that supplies a current to a first pixel electrode, and the organic EL device 11*b* includes a circuit that supplies a current to a second pixel electrode.

The circuit that drives the organic EL device 11 includes a drive transistor 12, a selection transistor 13, a switching transistor 14, a current control transistor 15, a first capacitor 16, and a second capacitor 17. The drive transistor 12, the selection transistor 13, the switching transistor 14, and the current control transistor 15 each may be a p-channel transistor.

The drive transistor 12 is connected to the organic EL device 11*a* and the organic EL device 11*b*, and supplies a drive current to the organic EL device 11*a* and the organic EL device 11*b*. More specifically, a drain electrode of the drive transistor 12 is connected to the anode electrode of the organic EL device 11*a* and the anode electrode of the organic EL device 11*b*.

A gate electrode of the selection transistor 13 is connected to a scanning line 19, a source electrode thereof is connected to a signal line 20, and a drain electrode thereof is connected to a gate electrode of the drive transistor 12. A signal that is written from an unillustrated vertical drive circuit through the scanning line 19 is applied to the gate electrode of the selection transistor 13.

A gate electrode of the switching transistor 14 is connected to a scanning line 21, a source electrode thereof is connected to a first power supply potential VDD, and a drain electrode thereof is connected to a source electrode of the drive transistor 12. A signal to control light emission is applied from the vertical drive circuit to the gate electrode of the switching transistor 14 through the scanning line 21.

The first capacitor 16 is connected between the gate electrode and the source electrode of the drive transistor 12. The second capacitor 17 is connected between the source electrode of the drive transistor 12 and the first power supply potential VDD.

The vertical drive circuit to which the scanning lines 19 and 21 are connected sequentially supplies a signal on a row basis to cause a signal voltage and a reference voltage to be held by a holding capacitor of each pixel, and controls the pixel to emit light with luminance corresponding to the signal voltage.

In the sub-pixel 10 including the above-described configuration, the selection transistor 13 is brought into a conductive state in response to the written signal applied from the vertical drive circuit to the gate electrode through the scanning line 19. The signal voltage corresponding to luminance information or the reference voltage is sampled by the operation, and the sampled voltage is written into the sub-pixel 10. Applying the reference voltage makes it possible to correct variation of a threshold voltage of the drive transistor 12 in each of the pixels, and to reduce luminance variation of each of the pixels due to the variation of the threshold voltage. The written signal voltage or reference voltage is applied to the gate electrode of the drive transistor 12 and is held by the first capacitor 16.

The switching transistor 14 is brought into a conductive state when a signal to control light emission is applied from the vertical drive circuit to the gate electrode through the scanning line 21. In other words, the switching transistor 14 includes a function of controlling light emission/non-light emission of the organic EL device 11.

The drive transistor 12 is designed so as to operate in a saturation region. The drive transistor 12 receives supply of the current from the power supply potential VDD through the switching transistor 14, thereby causing the organic EL device 11*a* and the organic EL device 11*b* to emit light through current driving. At this time, an amount of the current flowing through the organic EL device 11 is determined based on the voltage held by the first capacitor 16. Accordingly, the light emission amount of the organic EL device is controllable.

The current control transistor 15 controls the current flowing through the organic EL device 11*b*. A gate electrode of the current control transistor 15 is connected to the gate electrode of the drive transistor 12, and the conductive state is accordingly controlled based on the voltage held by the first capacitor 16. In other words, it is possible to control the ratio of the currents flowing through the organic EL device 11*a* and the organic EL device 11*b* to the current supplied through the drive transistor 12.

The current control transistor 15 is connected to the second pixel electrode, and may include a configuration that increases a current to be supplied to the second pixel electrode according to the magnitude of the input signal.

In the case of the present exemplary embodiment, the ratio of the current flowing through the organic EL display device 11*a* may be larger than that of the organic EL device 11*b* as the input signal voltage is smaller as the luminance to be displayed. Further, the current flowing through the organic EL device 11*b* may become larger as the input signal voltage is larger as luminance to be displayed. The ratio of the currents flowing through the organic EL device 11*a* and the organic EL device 11*b* depending on the luminance is controllable by, for example, adjusting a threshold of the current control transistor 15.

In the present exemplary embodiment, the respective currents flowing through the organic EL devices 11*a* and the organic EL device 11*b* are controlled by the circuit using the current control transistor 15. The circuit configuration, however, is not limited thereto as long as the ratio of the currents flowing through the organic EL devices 11*a* and the organic EL device 11*b* is controllable.

In FIG. 4, a p-channel metal oxide semiconductor (PMOS) transistor is used as the MOS transistor; however, N-channel metal oxide semiconductor (NMOS) transistor may be used. Further, the configuration of the drive circuit is not limited to the circuit configuration including three transistors and two capacitors. Moreover, as the MOS transistor, a transistor formed on a silicon wafer or a thin film transistor formed on a glass substrate may be used.

Figure 5:
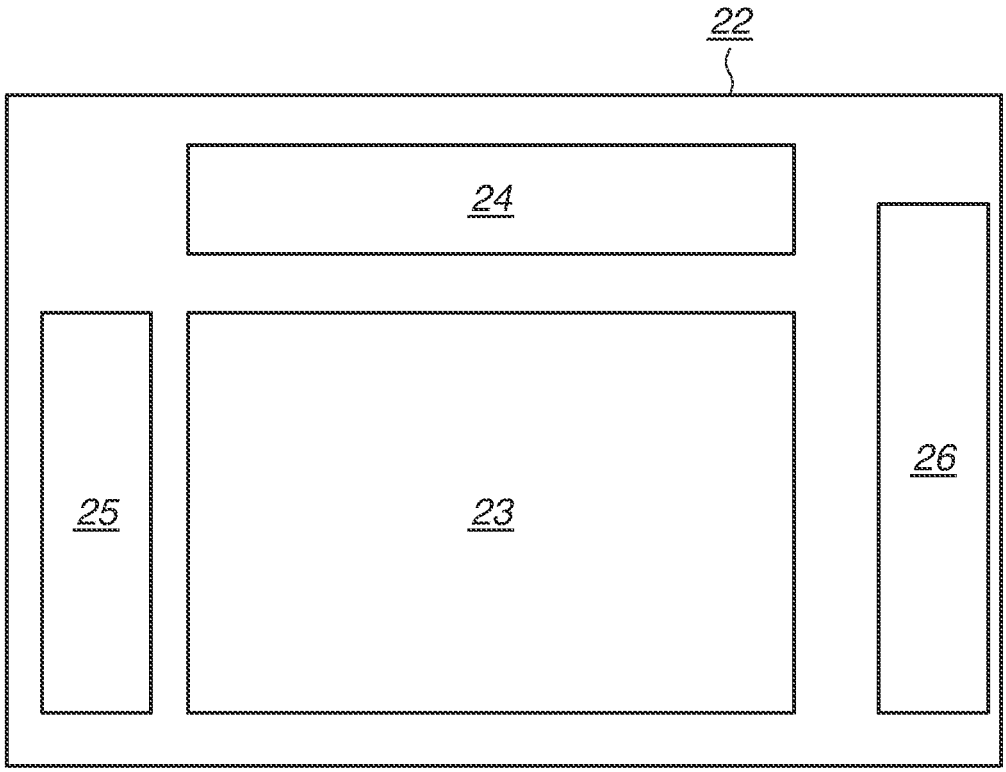
FIG. 5 is an entire schematic diagram illustrating an example of a display apparatus according to an exemplary embodiment of the present disclosure.

FIG. 5 is an entire schematic diagram illustrating an example of the organic EL display apparatus according to the exemplary embodiment of the present disclosure. An organic EL display apparatus 22 includes a display region 23, a horizontal drive circuit 24, a vertical drive circuit 25, and a connection terminal portion 26. A plurality of pixels is arranged in a matrix shape in the display region 23. Each of the pixels includes sub-pixels of red (R), green (G), and blue (B). The pixel circuit in FIG. 4 is disposed in each of the sub-pixels.

The horizontal drive circuit 24 outputs a data signal and is connected to the signal line 20. The vertical drive circuit 25 outputs a selection signal. The connection terminal portion 26 includes terminals that provide a clock signal, an image data signal, etc., to the horizontal drive circuit 24 and the vertical drive circuit 25, and is connected to the horizontal drive circuit 24 and the vertical drive circuit 25 through wirings (not illustrated).

As described above, in the exemplary embodiment of the present disclosure, the first pixel electrode 2 that is mainly supplied with a current in the case of the display with low luminance is preferably disposed at a position farther from the first electrode of the adjacent sub-pixel.

Figure 6:
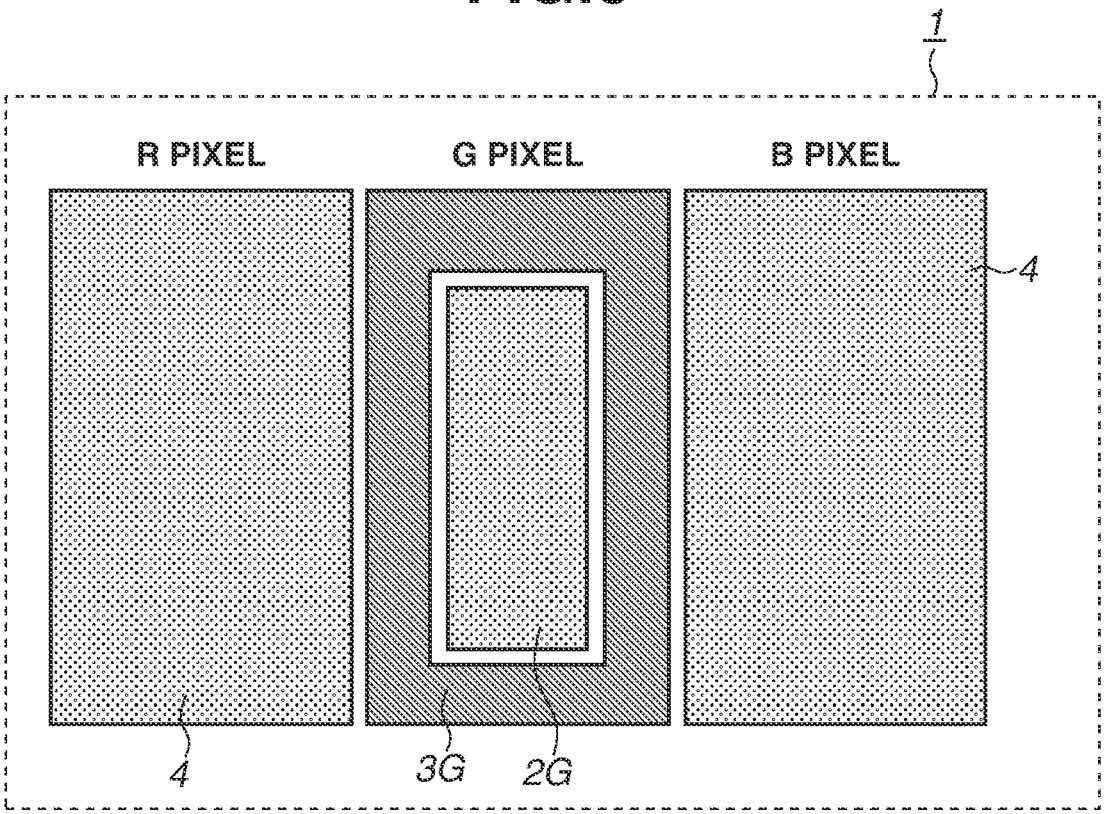
FIG. 6 is a plan view illustrating an example of a pixel according to an exemplary embodiment of the present disclosure.

A second exemplary embodiment is described. FIG. 6 is a plan view illustrating a pixel according to the present exemplary embodiment. The present exemplary embodiment is the same as the first exemplary embodiment except that only the first electrode of a specific sub-pixel includes the first pixel electrode and the second pixel electrode, and the first electrode of each of the other sub-pixels is not divided. The configuration and the description of the first exemplary embodiment are similarly applicable to the present exemplary embodiment.

In FIG. 6, the pixel electrode of only the G pixel is divided into the first pixel electrode 2G and the second pixel electrode 3G. The pixel electrode 4 of each of the R pixel and the B pixel is not divided. The pixel circuit of the G pixel includes, as illustrated in FIG. 4, the current control transistor 15 that controls the ratio of the currents flowing through the organic EL device 11*a* and the organic EL device 11*b*. In contrast, since the pixel electrode of each of the R pixel and the B pixel is not divided, only one organic EL device 11 is provided and the current control transistor is not provided.

The present exemplary embodiment is effective to improve color reproducibility in the low-luminance state in a case where the number of G pixels emitting light is larger than the respective numbers of the R pixels and the B pixels emitting light. Since the pixel electrode of each of the R pixel and the B pixel is not divided, it is possible to secure a large light emission area and to improve light emission efficiency as compared with the case where the pixel electrode of each of the R pixel and the B pixel is divided.

Figure 7:
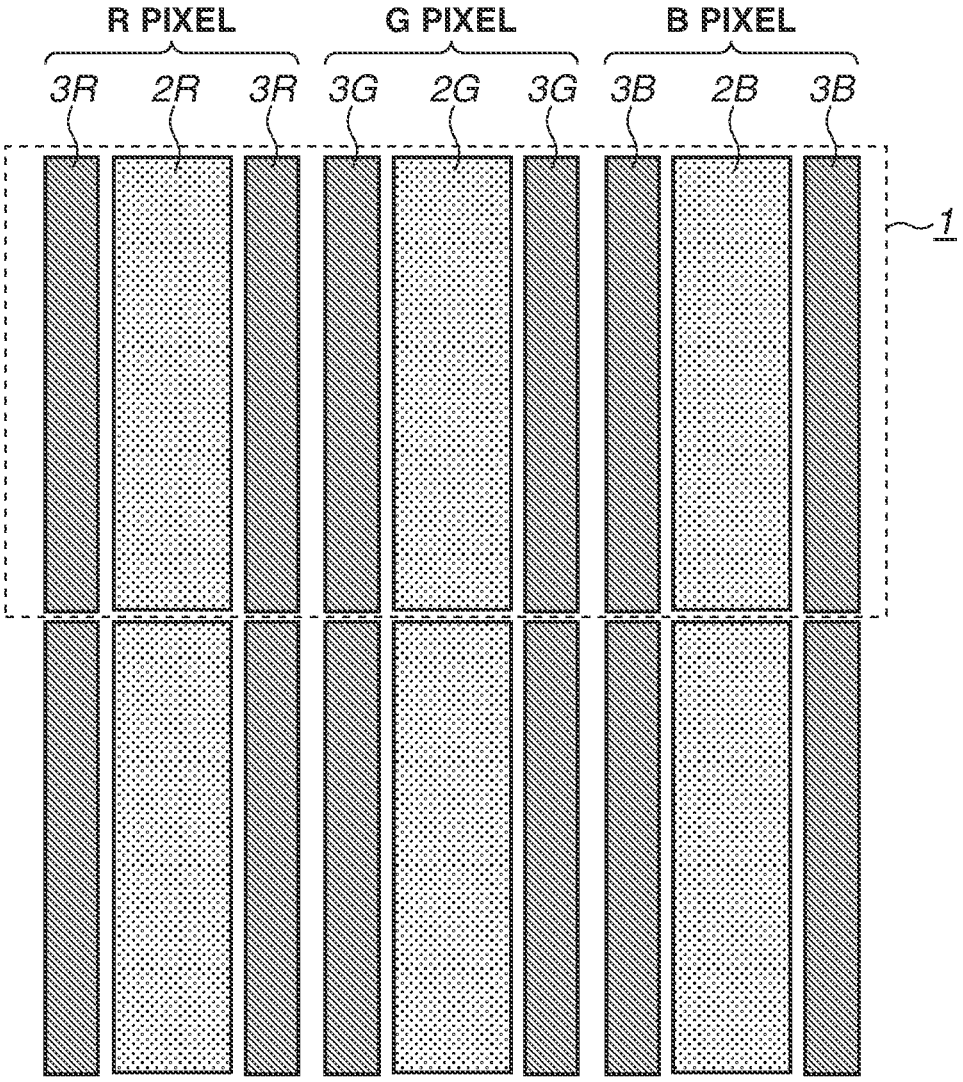
FIG. 7 is a plan view illustrating an example of a pixel according to an exemplary embodiment of the present disclosure.

A third exemplary embodiment is described. FIG. 7 is a plan view illustrating a pixel according to the present exemplary embodiment. The present exemplary embodiment is the same as the first exemplary embodiment except that the second pixel electrode is not provided between the first pixel electrodes of the respective sub-pixels emitting light of the same color. The configuration and the description of the first exemplary embodiment are similarly applicable to the present exemplary embodiment.

In the present exemplary embodiment, the second pixel electrode is disposed between the first pixel electrode of the sub-pixel and the first electrode of the adjacent sub-pixel of different color, whereas the second pixel electrode is not provided between the sub-pixels emitting light of the same color. In other words, the first pixel electrode may have a polygonal shape in a plane, and at least one of sides of the first pixel electrode may not be in contact with the second pixel electrode.

For example, since the second pixel electrode is not provided between the first pixel electrodes of the respective G pixels adjacent to each other, a distance between the first pixel electrodes of the respective G pixels is smaller than a distance between the first pixel electrodes of the sub-pixels of different colors. Accordingly, the leakage current between the pixel electrodes of the sub-pixels of the same color adjacent to each other becomes larger than the leakage current between the pixel electrodes of the sub-pixels of difference colors adjacent to each other; however, influence of the leakage current on color reproducibility is small because of the pixels of the same color.

Further, it is possible to secure a large light emission area of the first pixel electrode and to improve light emission efficiency as compared with the first exemplary embodiment.

OTHER EMBODIMENTS

The display apparatus according to the exemplary embodiment of the present disclosure may include a substrate. The substrate may be a substrate with high strength or a flexible substrate. More specifically, the substrate may be a substrate with high strength, such as a glass substrate or a silicon substrate. Alternatively, the substrate may be a flexible substrate such as a polyacrylic substrate or a polyimide substrate.

The display apparatus according to the exemplary embodiment of the present disclosure may include the first electrode, the functional layer, and the second electrode in this order from the substrate. Further, the display apparatus according to the exemplary embodiment of the present disclosure may be of a bottom emission type in which emitted light is extracted from the first electrode side, or of a top emission type in which emitted light is extracted from the second electrode side.

In the display apparatus according to the exemplary embodiment of the present disclosure, the first electrode may be an anode electrode. The first electrode may be a cathode electrode. The first electrode may be a reflective electrode. The first electrode may be a transmissive electrode. The first electrode may be a reflective anode electrode disposed on the substrate side. In a case where the first electrode is a cathode electrode disposed on the substrate side, an electron injection layer and an electron transport layer that are relatively low in water resistance are disposed away from outside air, which provides high water resistance as the display apparatus. In this case, the cathode electrode may be of a reflective type or of a transmissive type.

Examples of a material of the anode electrode include a metal simple substance such as gold, platinum, silver, copper, aluminum, titanium, nickel, palladium, cobalt, selenium, vanadium, or tungsten, an alloy of a combination thereof, and a metal oxide such as tin oxide, zinc oxide, indium oxide, indium tin oxide (ITO), or indium zinc oxide. Further, a conductive polymer such as polyaniline, polypyrrole, or polythiophene may be used.

Each of these electrode materials may be singularly used, or two or more kinds of these electrode materials may be used in combination. Further, the anode electrode may include a single layer or a plurality of layers.

On the other hand, examples of a material of the cathode electrode include an alkali metal such as lithium, an alkali earth metal such as calcium, and a metal simple substance such as aluminum, titanium, manganese, silver, lead, or chromium. Alternatively, an alloy of a combination of the metal simple substances may be used. For example, a combination of magnesium-silver, aluminum-lithium, or aluminum-magnesium may be used. A metal oxide such as indium tin oxide (ITO) may be used. Each of these electrode materials may be singularly used, or two or more kinds of these electrode materials may be used in combination. Further, the cathode electrode may include a single layer or a plurality of layers.

The organic EL layer configuring the organic EL device according to the exemplary embodiment of the present disclosure may include a single layer or a plurality of layers. In the case where the organic EL layer includes a plurality of layers, the organic EL layer may include a hole injection layer, a hole transport layer, an electron blocking layer, a light emitting layer, a hole blocking layer, an electron transport layer, and an electron injection layer.

The organic EL layer configuring the organic EL device according to the exemplary embodiment of the present disclosure may be manufactured with use of a dry process such as vacuum vapor deposition, ionization vapor deposition, sputtering, or a plasma process. In place of the dry process, a wet process may be used in which the organic EL layer is formed by a known coating method (e.g., spin coating, dipping, casting, a Langmuir-Blodgett (LB) method, or an inkjet method) by dissolving the material in an appropriate solvent.

When the layer is formed by vacuum vapor deposition, solution coating, or the like, crystallization, etc. hardly occurs and the layer is excellent in stability with time. When the layer is formed by coating, the film may be formed in combination with an appropriate binder resin.

Examples of the binder resin include a polyvinyl carbazole resin, a polycarbonate resin, a polyester resin, an acrylonitrile-butadiene-styrene (ABS) resin, an acrylic resin, a polyimide resin, a phenol resin, an epoxy resin, a silicone resin, and a urea resin; however, the binder resin is not limited thereto.

Further, each of the binder resins may be singularly used as a homopolymer or a copolymer, or two or more kinds thereof may be used as a mixture. Further, as necessary, a known additive (additives) such as a plasticizer, an oxidation inhibitor, and/or an ultraviolet absorber may be used in addition to the binder resin(s).

The display apparatus may be used as a display apparatus for a personal computer (PC). Further, the display apparatus may be an image display apparatus that includes an input unit receiving image information from an area charge-coupled device (CCD) sensor, a linear CCD sensor, or a memory card, an information processing unit processing the provided information, and a display unit displaying the provided image.

Further, the display apparatus may be used as a display unit included in an imaging apparatus or an inkjet printer. The display unit may be a display unit that displays an image captured by an imaging device. In this case, the display apparatus may include both of an image output function that displays image information provided from outside and an input function that receives process information of an image as an operation panel. In the case where the display apparatus includes the input function, the display apparatus may include a touch panel function. A type of the touch panel function may be an electrostatic capacitance type, a resistive film type, or an infrared type. Further, the input function may receive audio input.

In the case where the display apparatus is used in the imaging apparatus, the display apparatus may be provided on a housing of the imaging apparatus or may be used as a viewfinder.

The imaging apparatus may include an optical system that includes a plurality of lenses, and an imaging device that receives light having passed through the lenses.

Further, the imaging apparatus may include a housing and an imaging device housed in the housing, and the housing may be connectable to an optical system including a plurality of lenses.

As described above, according to the present disclosure, it is possible to provide the display apparatus that achieves excellent color reproducibility by suppressing influence of a sub-pixel on an adjacent sub-pixel different in emission color from the sub-pixel.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2017-183510, filed Sep. 25, 2017, which is hereby incorporated by reference herein in its entirety.

What is claimed is:

1. A display apparatus that includes a pixel including a first sub-pixel and a second sub-pixel disposed adjacently to each other, wherein the first sub-pixel emits a first color and the second sub-pixel emits a second color different from the first color, wherein each of the first sub-pixel and the second sub-pixel includes a first electrode, a second electrode, and a functional layer disposed between the first electrode and the second electrode, wherein the first electrode of the first sub-pixel includes a first pixel electrode and a second pixel electrode disposed adjacently to each other, wherein when a voltage is applied to the first pixel electrode and the second pixel electrode, the first pixel electrode and the second pixel electrode emit the first color, and wherein the second pixel electrode of the first sub-pixel is disposed in each of regions between the first pixel electrode and the second sub-pixel.

2. The display apparatus according to claim 1, further comprising a control unit configured to control a current to be supplied to each of the first pixel electrode and the second pixel electrode.

3. The display apparatus according to claim 2, wherein the control unit increases a ratio of the current supplied to the first pixel electrode to the current supplied to the second pixel electrode, as luminance to be displayed is smaller.

4. The display apparatus according to claim 2, wherein the control unit performs control for performing high dynamic range (HDR) display.

5. The display apparatus according to claim 1, wherein the second pixel electrode is disposed to surround the first pixel electrode.

6. The display apparatus according to claim 1, wherein the first pixel electrode has a polygonal shape in a plane, and wherein at least one of sides of the first pixel electrode is not adjacent to the second pixel electrode.

7. The display apparatus according to claim 1, wherein only the first sub-pixel includes the first pixel electrode and the second pixel electrode.

8. The display apparatus according to claim 1, wherein the functional layer is an organic electroluminescence (EL) layer.

9. The display apparatus according to claim 8, wherein the organic EL layer is a common layer disposed over a plurality of sub-pixels.

10. The display apparatus according to claim 9, further comprising a color filter, wherein the organic EL layer emits white light.

11. The display apparatus according to claim 8, wherein the first sub-pixel includes a substrate, the first electrode, the functional layer, and the second electrode in this order, and wherein the first electrode is a reflective electrode.

12. The display apparatus according to claim 8, wherein the first sub-pixel includes a substrate, the first electrode, the functional layer, and the second electrode in this order, and wherein the first electrode is a transmissive electrode.

13. The display apparatus according to claim 11, wherein the first electrode is an anode electrode.

14. The display apparatus according to claim 11, wherein the first electrode is a cathode electrode.

15. The display apparatus according to claim 1, further comprising a transistor connected to the second pixel electrode, the transistor increasing a current to be supplied to the second pixel electrode based on a magnitude of an input signal.

16. An imaging apparatus comprising:

an optical system including a plurality of lenses;

an imaging device configured to receive light having passed through the optical system; and a display apparatus configured to display a captured image, wherein the display apparatus is a display apparatus that includes a pixel including a first sub-pixel and a second sub-pixel disposed adjacently to each other, wherein the first sub-pixel emits a first color and the second sub-pixel emits a second color different from the first color, wherein each of the first sub-pixel and the second sub-pixel includes a first electrode, a second electrode, and a functional layer disposed between the first electrode and the second electrode, wherein the first electrode of the first sub-pixel includes a first pixel electrode and a second pixel electrode disposed adjacently to each other, wherein when a voltage is applied to the first pixel electrode and the second pixel electrode, the first pixel electrode and the second pixel electrode emit the first color, and wherein the second pixel electrode of the first sub-pixel is disposed in each of regions between the first pixel electrode and the second sub-pixel.

* * * * *